US007189061B2

(12) United States Patent
Hong et al.

(10) Patent No.: US 7,189,061 B2
(45) Date of Patent: Mar. 13, 2007

(54) COOLING FAN FOR VEHICLES

(75) Inventors: Tao Hong, Farmington Hills, MI (US); John R Savage, Rochester Hills, MI (US)

(73) Assignee: Valeo Electrical Systems, Inc., Auburn Hills, MI (US)

( * ) Notice: Subject to any disclaimer, the term of this patent is extended or adjusted under 35 U.S.C. 154(b) by 96 days.

(21) Appl. No.: 10/955,619

(22) Filed: Sep. 30, 2004

(65) Prior Publication Data

US 2006/0067826 A1 Mar. 30, 2006

(51) Int. Cl.
*F04D 29/32* (2006.01)

(52) U.S. Cl. ..... 416/145; 416/189; 29/889.3; 29/407.05

(58) Field of Classification Search ..... 416/132 A, 416/132 R, 169 A, 179, 189, 240, 144, 145; 74/572.1, 572.2, 572.21; 29/407.05, 407.07, 29/889.3

See application file for complete search history.

(56) References Cited

U.S. PATENT DOCUMENTS

| | | | | |
|---|---|---|---|---|
| 2,098,640 | A * | 11/1937 | Beecher | 416/203 |
| 2,366,795 | A * | 1/1945 | Lamorcaux | 416/145 |
| 5,961,289 | A * | 10/1999 | Lohmann | 416/189 |
| 6,168,734 | B1 * | 1/2001 | Botros | 264/40.1 |
| 6,224,335 | B1 * | 5/2001 | Parisi et al. | 415/206 |
| 6,508,621 | B1 * | 1/2003 | Zeighami et al. | 415/119 |
| 6,595,744 | B2 * | 7/2003 | Van Houten | 415/173.1 |

* cited by examiner

*Primary Examiner*—Edward K. Look
*Assistant Examiner*—Nathan Wiehe
(74) *Attorney, Agent, or Firm*—Jacox, Meckstroth & Jenkins

(57) ABSTRACT

A cooling fan having a circumferential ring. In ordinary fans of this type, deformation of fan blades causes the ring to buckle inward at locations between the blades. In one form of the invention, mass is added to the ring between the blades to counteract the buckling.

37 Claims, 10 Drawing Sheets

63
66
60
70
79
82
73
76
86
92
89
95
98
9A

RADIAL PLANE
AA
AXIAL PLANE 95
86
97
79
60

FIG - 26

| | | DEFLECTION | | | DIFFERENCE FROM BASE | | | Mm Defl. Vs Gm Mass Addition | |
|---|---|---|---|---|---|---|---|---|---|
| Ring Configuration | Blade Spacing | Radial (mm) | Axial (mm) | Mass (Gm) | Radial (mm) | Axial (mm) | Mass (Gm) | Radial mm/GM | Axial mm/GM |
| 2 mm Uniform | Equal | 0.79 | 2.04 | 324 | -0.08 | -0.33 | 0.0 | N/A | N/A |
| 2 mm Uniform (Base) | Un-Equal | 0.87 | 2.37 | 324 | Base | Base | N/A | N/A | N/A |
| 3 mm Uniform | Un-Equal | 0.67 | 1.88 | 368 | -0.20 | -0.49 | +44 | 0.0045 | 0.0111 |
| 4 mm Uniform | Un-Equal | 0.39 | 1.13 | 440 | -0.48 | -1.24 | +116 | 0.0041 | 0.0107 |
| 3 mm In Gaps | Un-Equal | 0.34 | 1.14 | 352 | -0.53 | -1.23 | +28 | 0.0189 | 0.0535 |

COOLING FAN FOR VEHICLES

The invention relates to cooling fans, particularly of the type wherein fan blades are supported at their blade tips by a circumferential ring. The invention reduces deformation of the ring.

BACKGROUND OF THE INVENTION

FIG. 1 illustrates a motor vehicle 3. Many such vehicles contain cooling fans, represented by block 6. Two such fans are illustrated in FIGS. 2 and 3. Fan 9 has equally spaced blades. Fan 12 has unequally spaced blades.

In examining these fans, the inventors have observed that, in operation, and especially at the temperatures encountered in the engine compartment of the vehicle 3 in FIG. 1, the fans 9 and 12 experience deformation. The deformation reduces aerodynamic efficiency.

In addition, the fans are designed to produce minimal noise, but the deformation increases the noise. How a fan produces noise can be understood by a simplified example.

Every time a blade of a fan passes an observer, the blade delivers a small pressure pulse. One can easily prove this by listening to a ceiling fan. Every time a blade passes, a small whooshing sound is perceived. The sound is produced by a small pressure pulse.

A ceiling fan is a low-speed fan. In a high-speed fan, such as that represented in FIG. 1, speeds can reach 2400 rpm, and higher. If the fan has five blades, as illustrated in FIGS. 2 and 3, then 12,000 pulses occur per minute (5×2,400), which correspond to about 200 pulses per second (12,000/60).

The sequence of 200 pulses per second resembles roughly a sine wave of about the same frequency. Humans perceive these pulses as a hum or buzz at about 200 Hz.

To reduce the hum or buzz, various approaches have been developed to reduce the size of the pressure pulses produced by the fans in question, and many have been quite successful. However, when the fans deform in operation as described above, the reduction in noise which was previously attained becomes somewhat compromised.

Therefore, the inventors have discovered that certain cooling fans, especially when operating in a high-temperature environment, experience a change in shape which causes a reduction in aerodynamic efficiency and also produces undesirable noise. The inventors have developed strategies for mitigating these undesirable effects.

OBJECTS OF THE INVENTION

An object of the invention is to provide an improved cooling fan.

A further object of the invention is to provide a cooling fan which experiences reduced deformation in operation, particularly in a high-temperature environment.

SUMMARY OF THE INVENTION

In one form of the invention, mass is added to a ring surrounding and connected to blades of a cooling fan.

In one aspect, this invention comprises an apparatus comprising a cooling fan having an array of swept fan blades surrounded by a ring connected to tips of the blades, and means for preventing deflection of the fan blades from causing inward buckling of the ring at locations between the tips.

In still another aspect, this invention comprises an apparatus comprising: a cooling fan having fan blades whose tips support an outer ring, and masses embedded in the ring in sectors between the blades and constructed of material of greater density than the ring.

In yet another aspect, this invention comprises an apparatus comprising: a cooling fan having a rotor which includes two elements: fan blades, and an annular ring supported by the blades, and one or more masses, distributed along the ring, such that greater mass is present between blades than radially outside the blades.

In still another aspect, this invention comprises a cooling fan comprising: at least two fan blades having tips, and a structure spanning between, and connecting to, the tips of the two blades, the structure being more massive near its mid-point than near the tips.

In yet another aspect, this invention comprises a cooling fan comprising: an array of fan blades, each having a tip, wherein all tips together define a tip circle, a ring which is connected to the tips at connection regions, lies outside the tip circle, and is more massive at mid-points between connection regions, than at the connection regions.

In still another aspect, this invention comprises a method, comprising the steps of: performing a computer simulation of a cooling fan, which fan includes fan blades and a ring which surrounds the blades, is connected to the tips of the blades, and is unsupported between the tips, observing that, in operation, the ring bows inward at its unsupported regions, and adding simulated mass at the unsupported regions, and performing at least one additional simulation.

In yet another aspect, this invention comprises a method comprising the steps of: maintaining a cooling fan which includes fan blades, and maintaining an outer ring, supported by the fan blades, which has a larger mass density between blades than at other places.

In still another aspect, this invention comprises a cooling fan, comprising: at least two fan blades having tips, and a structure spanning between, and connecting to, the tips of the two blades, the structure being more massive at one location, compared to other locations.

In yet another aspect, this invention comprises a cooling system for a vehicle, comprising: a cooling fan comprising a plurality of fan blades, and a motor for driving an annular ring surrounding the blades, the annular ring comprises at least one mass or weight between least two of the plurality of fan blades for improving performance of the cooling fan, and the annular ring comprises at least one sector between the at least two of the plurality of fan blades.

In still another aspect, this invention comprises an apparatus, comprising: a fan having blades connected to a ring, wherein deformation occurs in the ring during operation, and means for reducing the deformation.

Other objects and advantages of the invention will be apparent from the following description and the accompanying drawings.

BRIEF DESCRIPTION OF THE DRAWINGS

FIG. 26 indicates test data obtained from computer simulations.

DETAILED DESCRIPTION OF THE INVENTION

Figure 3:
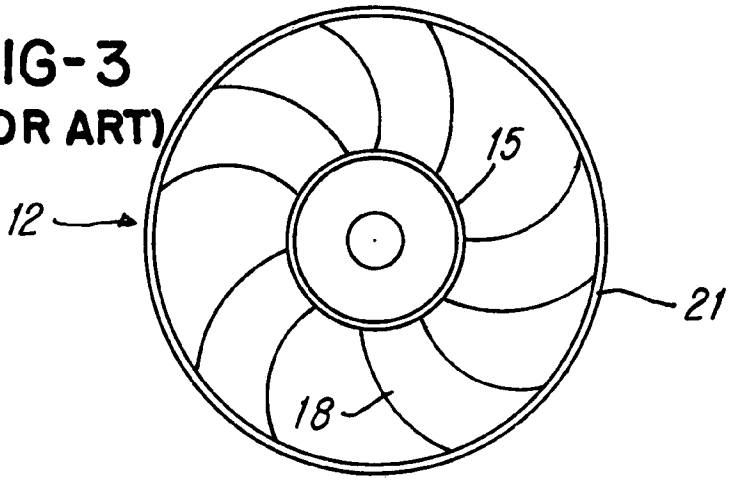
FIG-3 (PRIOR ART)
FIGS. 2 and 3 illustrate two prior-art cooling fans.
Figure 4:
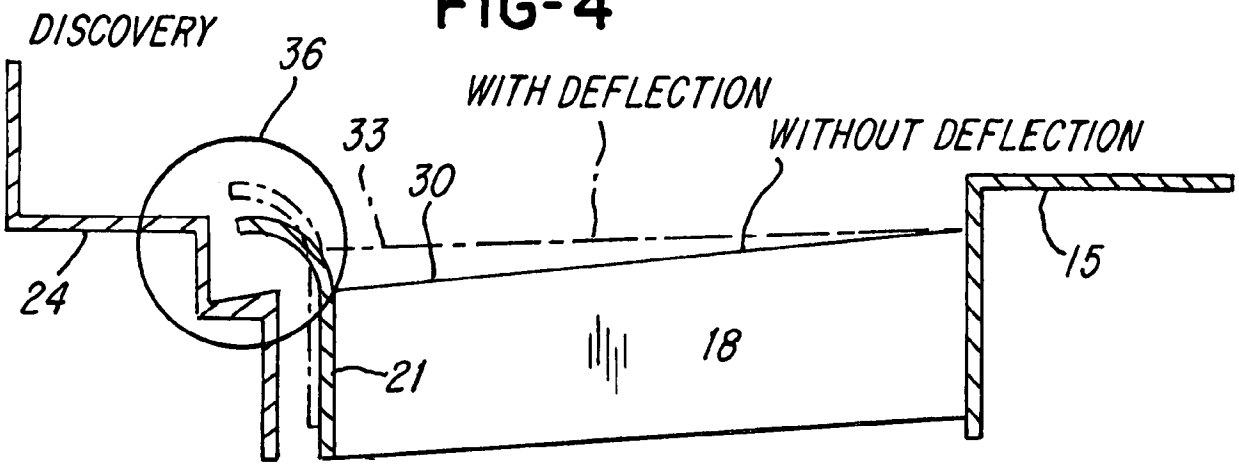
FIG. 4 illustrates a discovery made by the inventors.

FIG. 4 illustrates a discovery made by the inventors. FIG. 4 represents, in cross-section, the type of fan hub 15, fan blade 18, and fan ring 21 shown in FIG. 3. FIG. 4 also shows a shroud side wall 24, which is not shown in FIG. 3.

Figure 5:
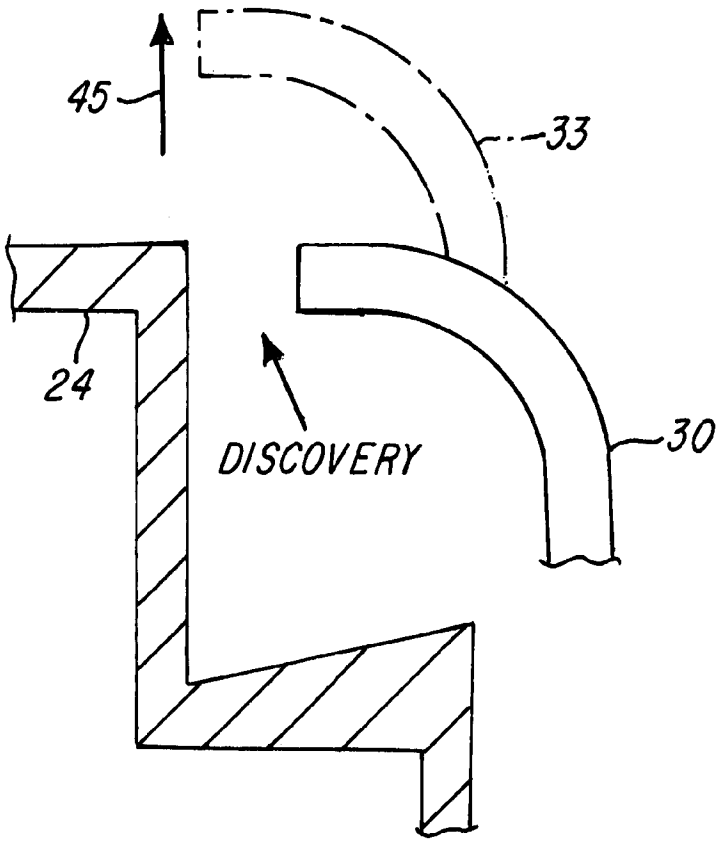
FIG. 5 is an enlargement of region 36 in FIG. 4.

The inventors have observed that, during operation, the fan ring 21 deforms from position 30 to position 33. FIG. 5 is an enlargement of region 36 in FIG. 4. FIG. 5 illustrates a movement in two directions by the fan ring 21. Arrow 42 represents a radial movement, and arrow 45 represents an axial movement.

Clearance between the fan 33 and the wall 24 has increased, allowing leakage.

Some simple explanations explaining why these deformations occur will be given, with reference to FIGS. 6–11. First, FIGS. 6 and 7 will be explained, establishing a reference frame.

Figures 6, 7, 8, 9, 10:
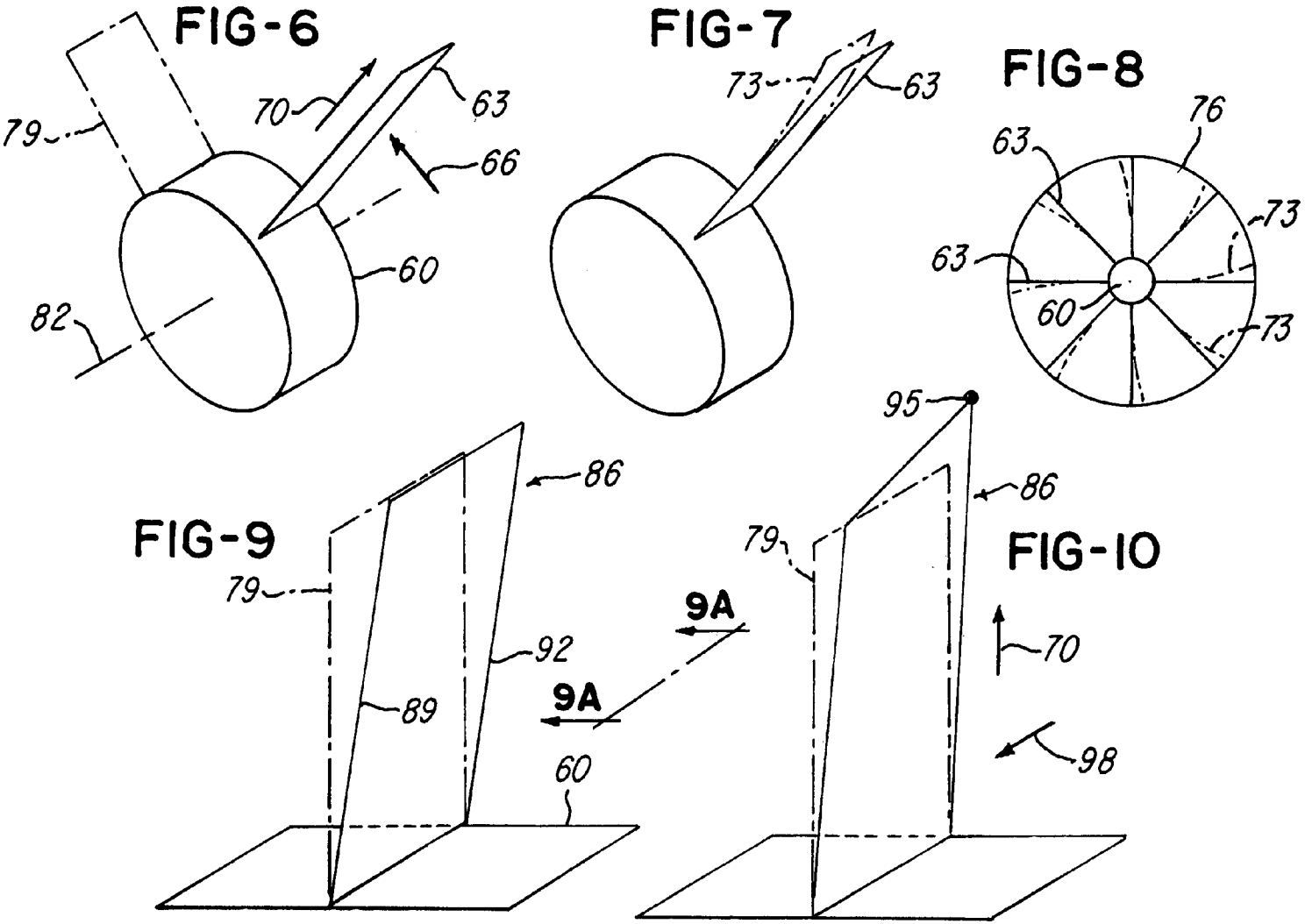
FIG. 6 illustrates a simplified fan blade 63.
FIG. 7 illustrates deformation of the fan blade of FIG. 6 under aerodynamic loading.
FIG. 8 illustrates deformation of a collection of blades 63.
FIG. 9 illustrates a swept fan blade 86.
FIG. 10 illustrates deformation of the fan blade of FIG. 9.

FIG. 6 illustrates a simplified fan hub 60, and an idealized fan blade 63. Arrow 66 represents the collective forces imposed by aerodynamic loading. Arrow 70 represents the collective forces of centrifugal loading.

The aerodynamic forces 66 tend to bend the idealized blade 63 into the phantom position 73 indicated in FIG. 7. However, the centrifugal forces 70 do not bend the idealized blade 63, since all these forces are co-linear with the idealized blade 63. (However, the centrifugal forces 70 can stiffen the idealized blade 63.)

FIG. 8 shows an array of idealized blades 63 extending from the hub 60. If the aerodynamic loading 66 of FIG. 6 is the only load applied to the idealized blade 63, and if all blades 63 are identical, then all blades 63 in FIG. 8 will bend equally into the phantom positions 73, causing a small relative rotation of the fan ring 76 with respect to the hub 60.

The bending indicated in FIGS. 6 and 7 changes the aerodynamic shape of the blades 63, thus causing a change in aerodynamic behavior of the blade 63. Of course, the blades 63 will probably be designed to anticipate this bending.

Figures 6A, 9A, 10A, 10B:
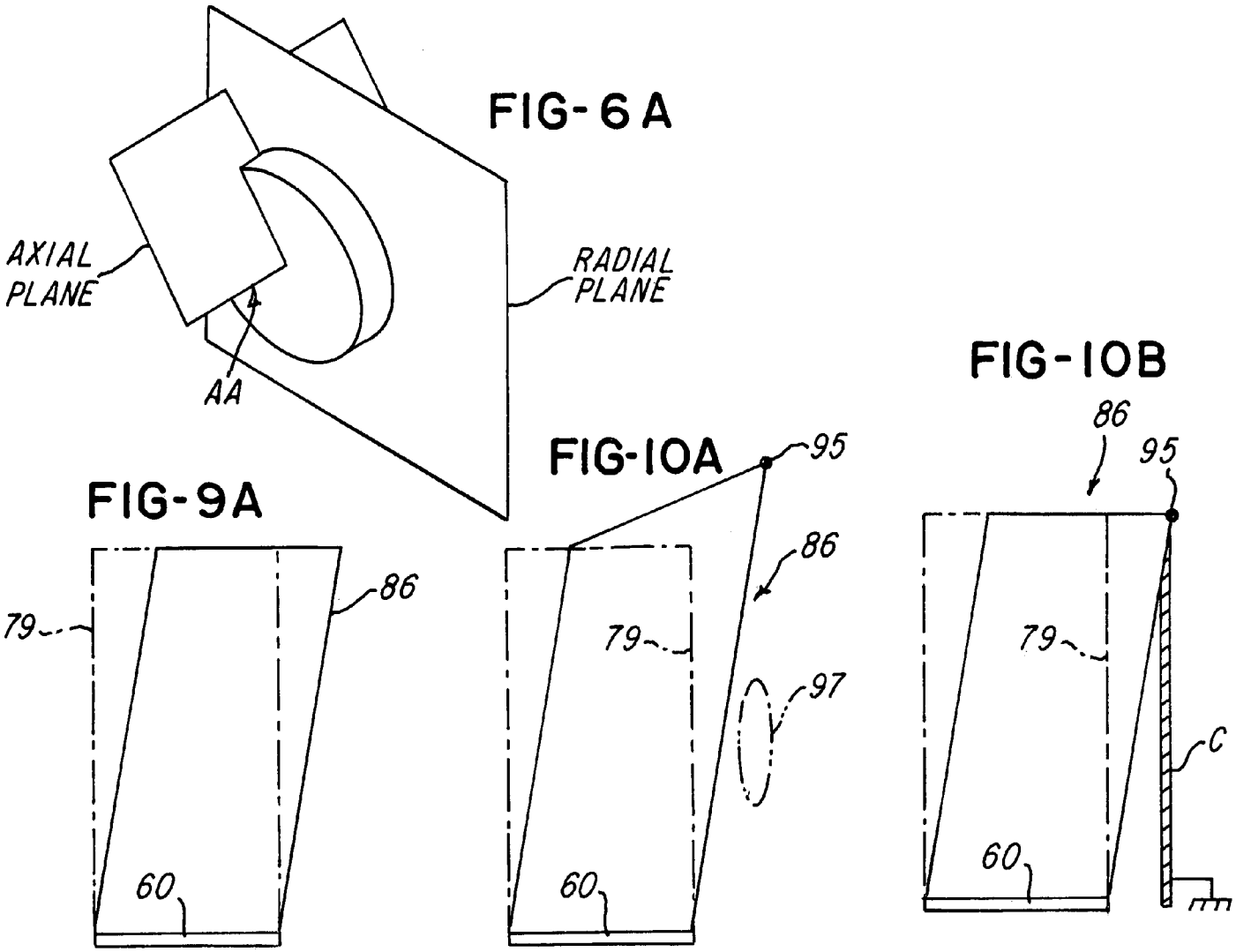
FIG. 6A illustrates definitions of "axial plane" and "radial plane."
FIG. 9A is a plan view of FIG. 9.
FIG. 10A is a plan view of FIG. 10.
FIG. 10B is a plan view of a view similar to that of FIG. 9, but with an added hypothetical cable C, which pulls point 95 radially inward.

The blade 63 just examined were non-swept, and were shown as aligned in axial planes. Plane 79 in FIG. 6 represents an axial plane. An axial plane is parallel to the axis 82. FIG. 6A sets forth a coordinate system which defines axial and radial planes. An axial plane contains the axis AA. A radial plane is defined by all radii emanating from a single point.

FIG. 9 illustrates in simplified form a swept blade 86, with straight leading edge 89 and a straight trailing edge 92. Hub 60 is shown, for simplicity, as flat. The axial plane 79 of FIG. 6 is shown for reference. Blade 86 is co-planar with the plane 79. FIG. 9A is an elevational view, taken along arrows 9A in FIG. 9.

FIG. 10 shows the centrifugal loading force 70 of FIG. 6. FIG. 10A is an elevational view. In those FIGS. 10 and 10A, force 70 (FIG. 10) tends to pull point 95 radially outward, in the direction of arrow 70, as indicated in grossly exaggerated form. Force 70 may also result in movement of point 95 in a forward direction, parallel to arrow 98, because of the reaction of parts of the blade 86 to the force 70.

One reason for the movement of point 95 is that no material is present in region 97 in FIG. 10A. If, for example, material were present, represented by a hypothetical cable C in FIG. 10B, then the movement of point 95 may be reduced. But, as stated, no material performing the function of cable C is present in region 97 in FIG. 10A.

Figure 11:
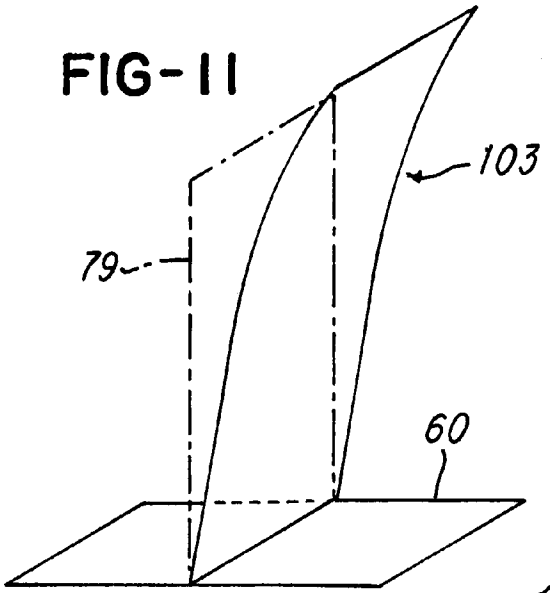
FIG. 11 illustrates a swept fan blade.

When the blade 86 is constructed with curved leading and trailing edges, similar types of deformation occur. FIG. 11 illustrates such a blade 103, but still aligned in an axial plane 79. That is, the blade 103 is co-planar with axial plane 79.

Figure 2:
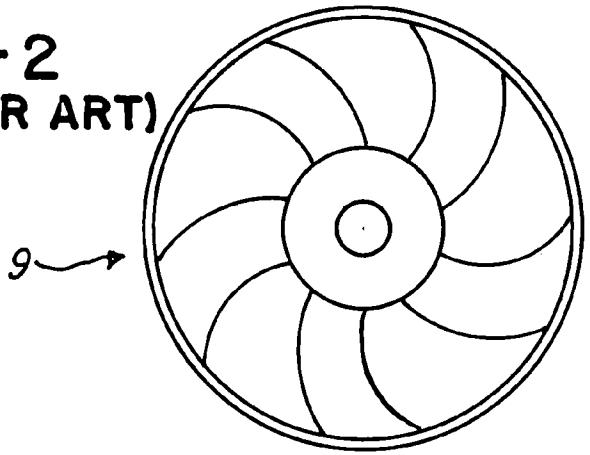
FIG-2 (PRIOR ART)
Figure 12:
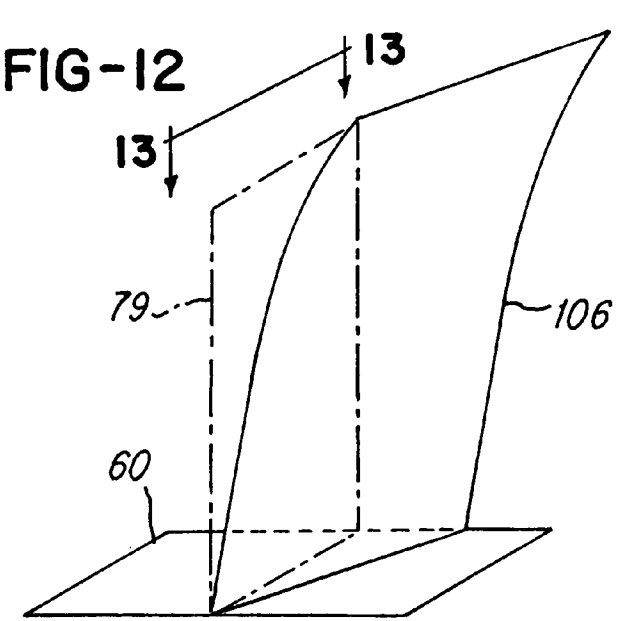
FIG. 12 illustrates a swept fan blade which is not fully contained in axial plane 79.
Figure 13:
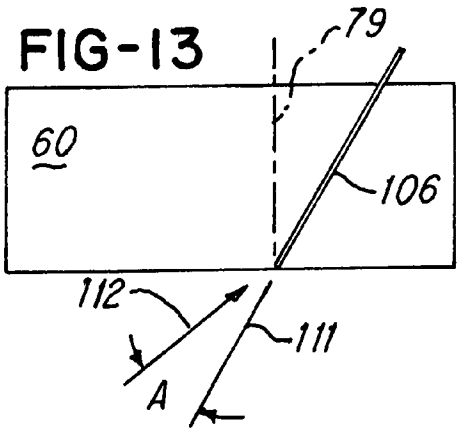
FIG. 13 illustrates a definition of angle-of-attack.

The blades of the fans shown in FIGS. 2 and 3 are not axially aligned as shown in FIG. 11, but are slanted as is blade 106 in FIG. 12. One reason is to give the blade 106 the proper angle-of-attack during operation. FIG. 13 is a view of FIG. 12, taken along arrows 13—13, and illustrates the basic idea of angle of attack.

In FIG. 13, line 111 is an extension of the blade 106. Arrow 112 represents an incoming air stream. Angle A represents the angle-of-attack.

Figure 14:
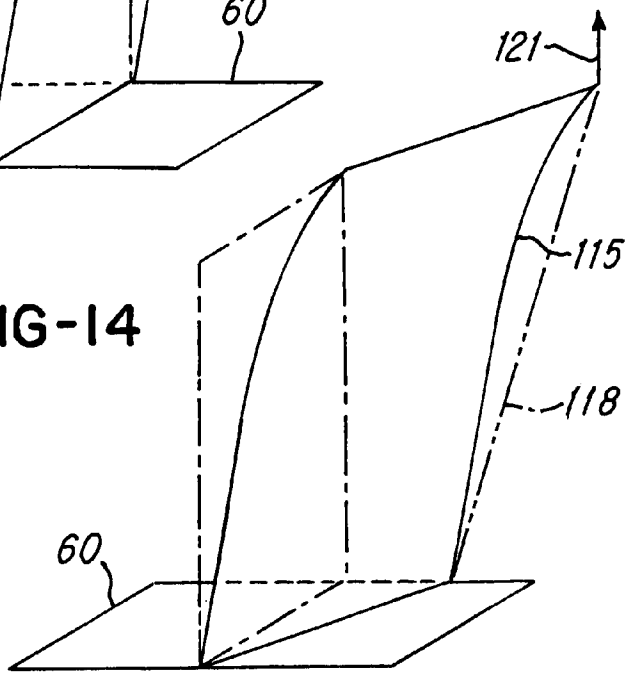
FIG. 14 illustrates deformation of the fan blade of FIG. 12.

FIG. 14 illustrates one reason why the movement of point 95 in FIG. 10 can be greater with a swept blade having a curved trailing edge 115 in FIG. 14. With such a trailing edge, material is absent in the region bounded by trailing edge 115 and dashed line 118. Dashed line 18 lies in an analogous position to the straight trailing edge 92 in FIG. 9.

Thus, with a curved trailing edge 115, additional material is missing in addition to that of region 97 in FIG. 10A. The additional material is that lying between trailing edge 115 in FIG. 14 and dashed line 118. That material, if present, could act as a web and absorb tensile load imposed by a force indicated by arrow 121 in FIG. 14. But such a web is not present in the blade shown in FIG. 14.

Therefore, the preceding discussion has given a simplified explanation, based on observations made by the Inventor, of one set of reasons explaining why the deformation shown in FIG. 4 can occur.

Figure 15:
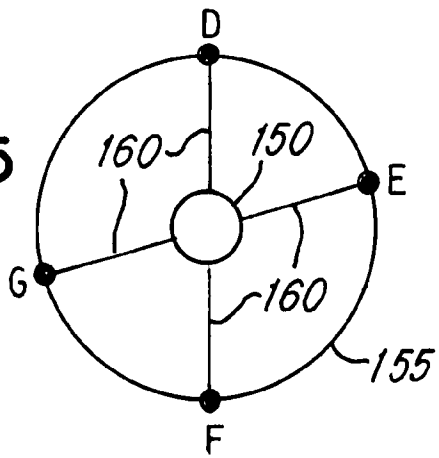
FIG. 15 illustrates, in simplified plan view, blades 160 and ring 155.
Figure 16:
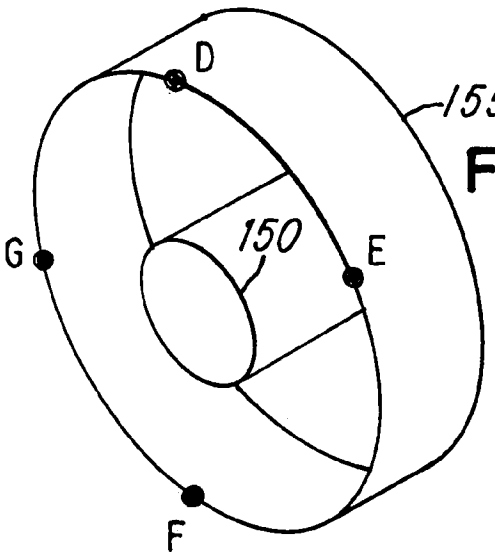
FIG. 16 is a perspective view of the apparatus of FIG. 15.

The Inventors have further observed that specific types of deformation occur. FIG. 15 illustrates schematically a fan, containing four blades 160, a hub 150, and a ring 155, which connects to the tips of the blades 160. Dots E, F, G, and H are reference points, and indicate points-of-attachments of the blades 160 to the ring 155. FIG. 16 illustrates the situation in perspective view, with the blades omitted for clarity.

In operation, parts of the tips of the blades move radially outward, as explained in connection with FIGS. 10 and 10A above. This movement effectively lengthens the blades, as shown schematically in FIG. 17. Since the ring 155 is connected to the tips of the blades 160, the ring is constrained to deform into the shape 155A (FIG. 17) indicated, which is, of course, shown in exaggerated form.

Figure 18:
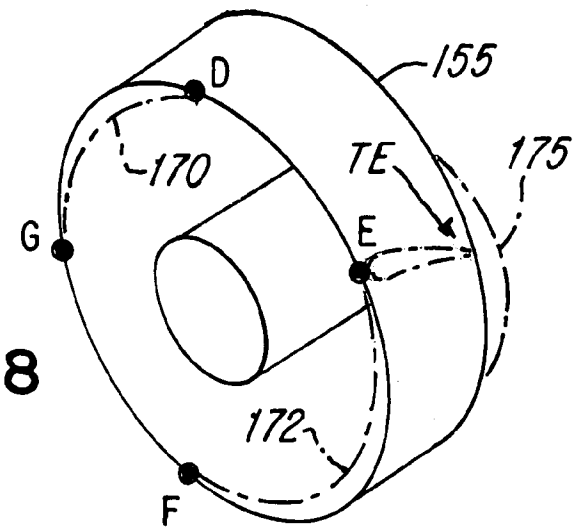
FIG. 18 illustrates the deformation of FIG. 17 in perspective view.

The Inventors, through computer simulation, have found that a specific type of deformation occurs in the ring 155, as shown in FIG. 18. The region of the ring 155 between points D and G, which points represent the junctions between the tips of blades (not shown) and the ring 155, is drawn radially inward, as indicated by dashed line 170. A similar observation applies to dashed line 172, lying between points E and F.

However, the part of the ring 155 at the trailing edge TE of a blade 160 bulges radially outward, as indicated by bulge 175 in FIG. 18.

Figure 17:
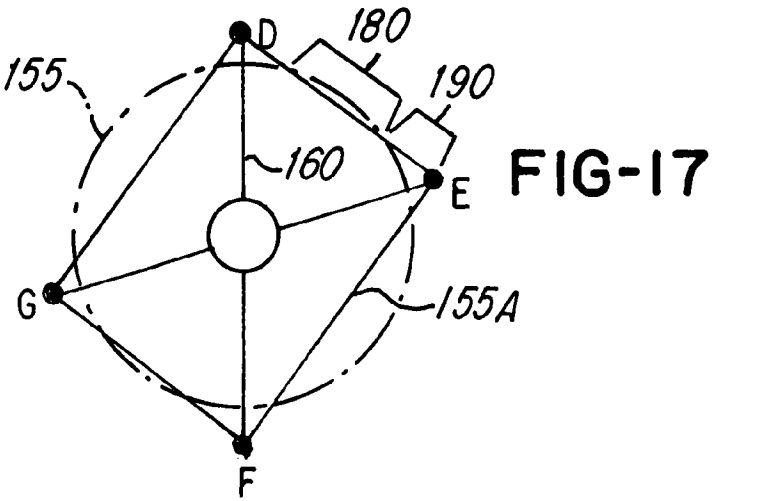
FIG. 17 illustrates, in exaggerated view, how ring 155 is deformed when the tips of blades 160 move radially outward.

The inward and outward bulging is consistent with the exaggerated view shown in FIG. 17. Region 180 shows an inward bulge of the ring 155, namely, the straight line between points D and E, compared with its rest position which is indicated by phantom ring 155. This inward bulge in region 180 is consistent with bulge 170 in FIG. 18.

On the other hand, region 190 in FIG. 17 shows an outward bulge, consistent with outward bulge 175 in FIG. 18.

Figure 19:
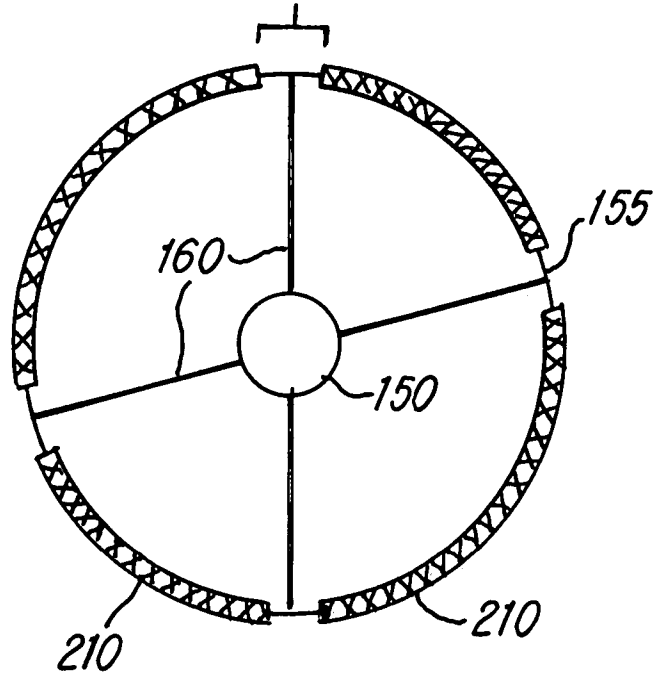
FIG. 19 illustrates, in plan view, how added mass is located between blades 180, and not in sectors 220, which are radially outward of blades 160.

To counteract the deformation illustrated in FIGS. 17 and 18, mass or weight was added to the ring 155, at regions between the blades, but not at the blades themselves. FIG. 19 illustrates the mass, as shaded sectors 210. Four blades 160 are shown, and their spacing is not equal. That is, they are not 90 degrees apart. Other blade numbers can be used.

Several significant features of the addition of mass 210 are the following.

One is that the mass is preferably not added radially outward of the blades. That is, for example, mass is not added in sector 220 in FIG. 19, nor to any corresponding sector outside other blades.

Figure 20:
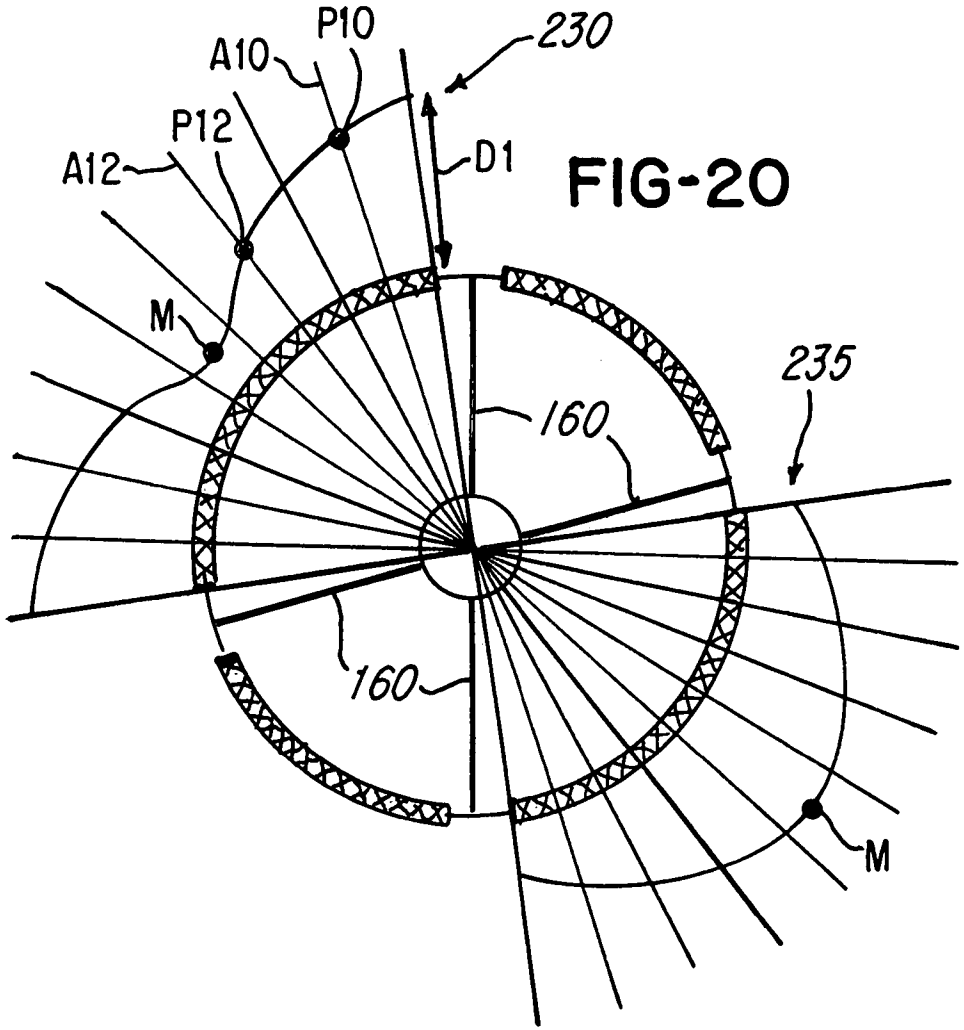
FIG. 20 illustrates plots, in radial coordinates, of mass versus position.

A second feature is that the mass need not be uniformly distributed. FIG. 20 illustrates two types of mass distribution, wherein radial distance, such as distance D1, represents amount of mass, plotted as a function of position. For example, point P10 represents an amount of mass added at angular position A10. Point P12 represents an amount of mass added at angular position A12. Point P10 indicates that a larger mass is added at angular position A10, compared with point P12.

Plot 230 indicates that the mass is lowest at the mid-point M between neighboring blades 160. In another embodiment, plot 235 indicates that the mass is maximal at the mid-point M between neighboring blades 160.

FIG. 20 indicates a continuous distribution of mass. However, a continuous distribution is not seen as strictly necessary. Instead, mass can be added in discrete units, analogous to the wheel weights which are added to automotive wheels in a wheel-balancing process.

Figure 21:
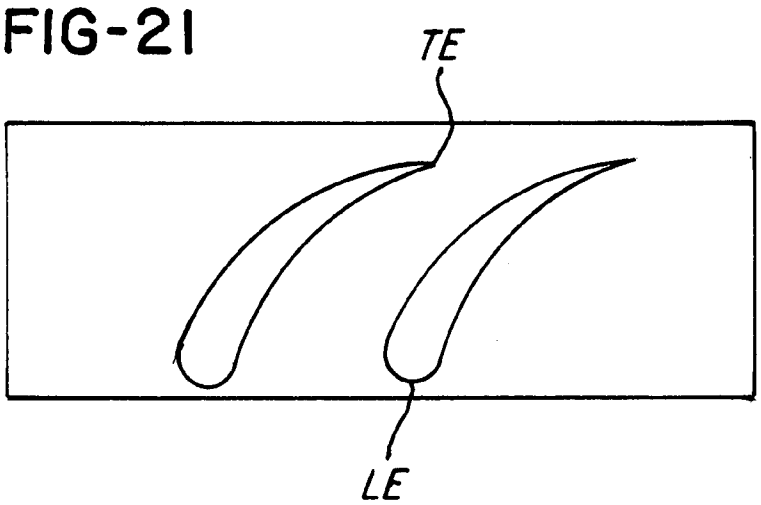
FIG. 21 shows that the leading edge LE of one blade can lie directly behind the trailing edge TE of another blade.

A third feature is that the mass need not be uniformly distributed in the axial direction. FIG. 21 illustrates this concept.

In some fans, the leading edge of LE one blade can lie ahead of the trailing edge TE of an adjacent blade. It can expected that the bulging of the ring 155 will be different at the leading edge LE, compared with the trailing edge TE, despite the fact that the leading edge LE and the trailing edge TE lie on a common axial plane AP.

Thus, different masses may be required at the leading edge LE, compared with the trailing edge TE.

Figure 23:
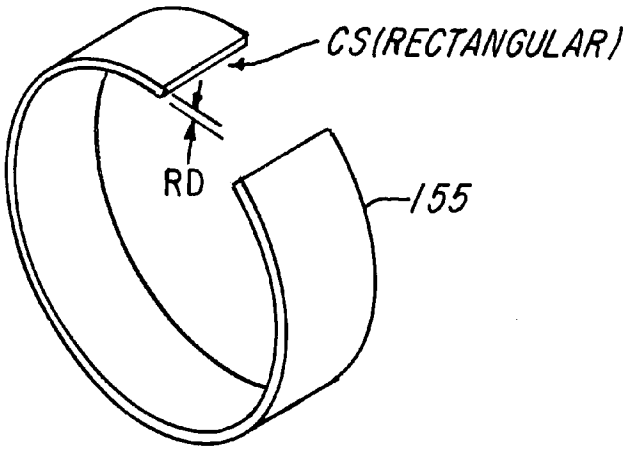
FIG. 23 illustrates the rectangular cross section of ring 155 in FIG. 22.
Figure 24:
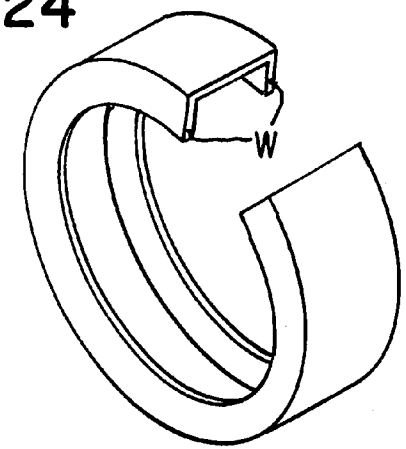
FIG. 24 illustrates webs W added to ring 155.
Figure 22:
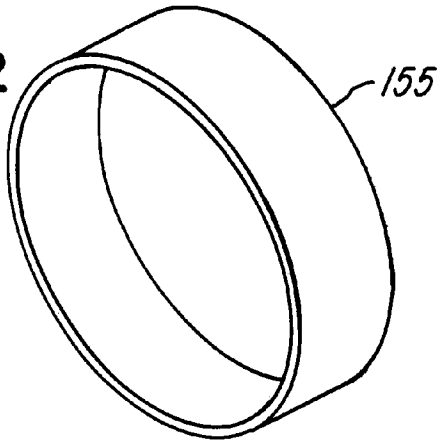
FIG. 22 illustrates ring 155.

A fourth feature is that the bulging of FIGS. 10 and 10A is reduced by the outward centrifugal force due to the added mass in the ring. The reduction is not caused by stiffening the ring 155 in FIG. 16, at least not to the maximal extent possible. FIGS. 22–24 illustrate this.

FIG. 22 illustrates ring 155. FIG. 22 is a cut-away view, and indicates that the cross-section CS is rectangular. In one form of the invention, the mass 210 in FIG. 19 is added by increasing the radial depth RD, or thickness, of the ring 155.

However, if stiffness of the ring 155 were to be increased, another approach would be taken. An increase in stiffness would require an increase in the moment-of-inertia of the ring, which would require fabrication of webs, such as webs W shown in FIG. 24. An example will illustrate the distinction.

Figure 25:
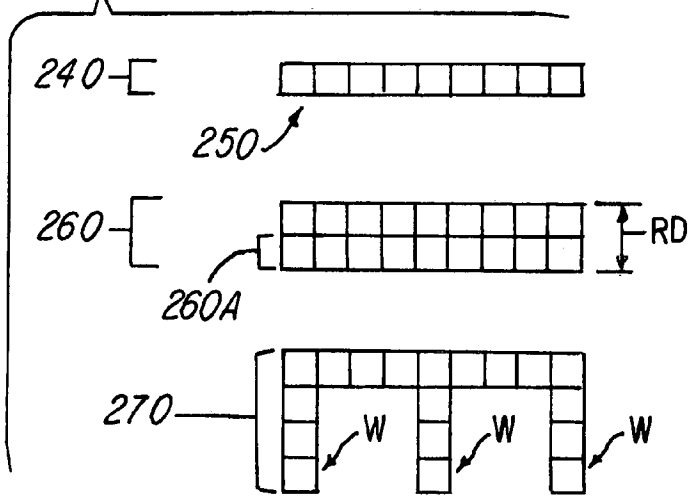
FIG. 25 illustrates, in cross-sectional view, two different ways in which the same amount of mass can be added to a ring.

FIG. 25, image 240, shows the rectangular cross section 250 of the ring, which corresponds to cross section CS in FIG. 23. In FIG. 25, the cross section 250 is divided into nine squares for reference.

Assume that the amount of material in the cross section 250 is to be doubled. Image 260 illustrates one possibility, wherein the radial depth RD is doubled. Nine squares have been added, making eighteen squares total. Image 270 illustrates another possibility, wherein webs W are formed. The additional nine squares are formed into webs W.

Thus, material, or mass, can be added to the ring 155 in at least two ways. One way simply increases the thickness of the ring 155, as in image 260 in FIG. 25. Another way increases the moment of inertia, as in image 270. The latter approach increases stiffness more than does the former way.

However, in one form of the invention, the webs W effectively decrease the inner diameter of the ring, obstructing airflow into the fan, which is not desired. Consequently, in one form of the invention, it is preferred to add mass without obstructing airflow, as in image 260 in FIG. 25.

In one form of the invention, the additional mass shown in image 260 in FIG. 25 can be viewed as occupying, or adding, minimal radial depth RD. That is, the additional mass is spread out, in the form of a cylindrical layer of uniform thickness represented by layer 260A. This layer, being uniform in thickness, spreads out the additional mass in a layer of the smallest thickness possible, thereby increasing radial depth RD in the smallest amount.

In contrast, the webs W in image 270 do not have this property of smallest increase in radial depth. Webs 270 could be re-arranged into the layer shown in image 260, to thereby decrease radial depth.

Thus, it should be understand that the sections or areas of ring 155 between adjacent blades that have additional weight or mass may comprise a different thickness or density than other areas of the ring 155, and even within the same section (such as sectors 210) may comprise a density and/or thickness that changes across its cross-section.

It is also possible to create a cylindrical layer of non-uniform radial depth. For example, small webs W of FIG. 270 can be fabricated, with added material between the webs W.

A fifth feature is that additional mass can be added by embedding a high-mass material, such as a metal such as lead, into the ring 155. The high-mass material has a higher density than the ring 155.

Figure 1:
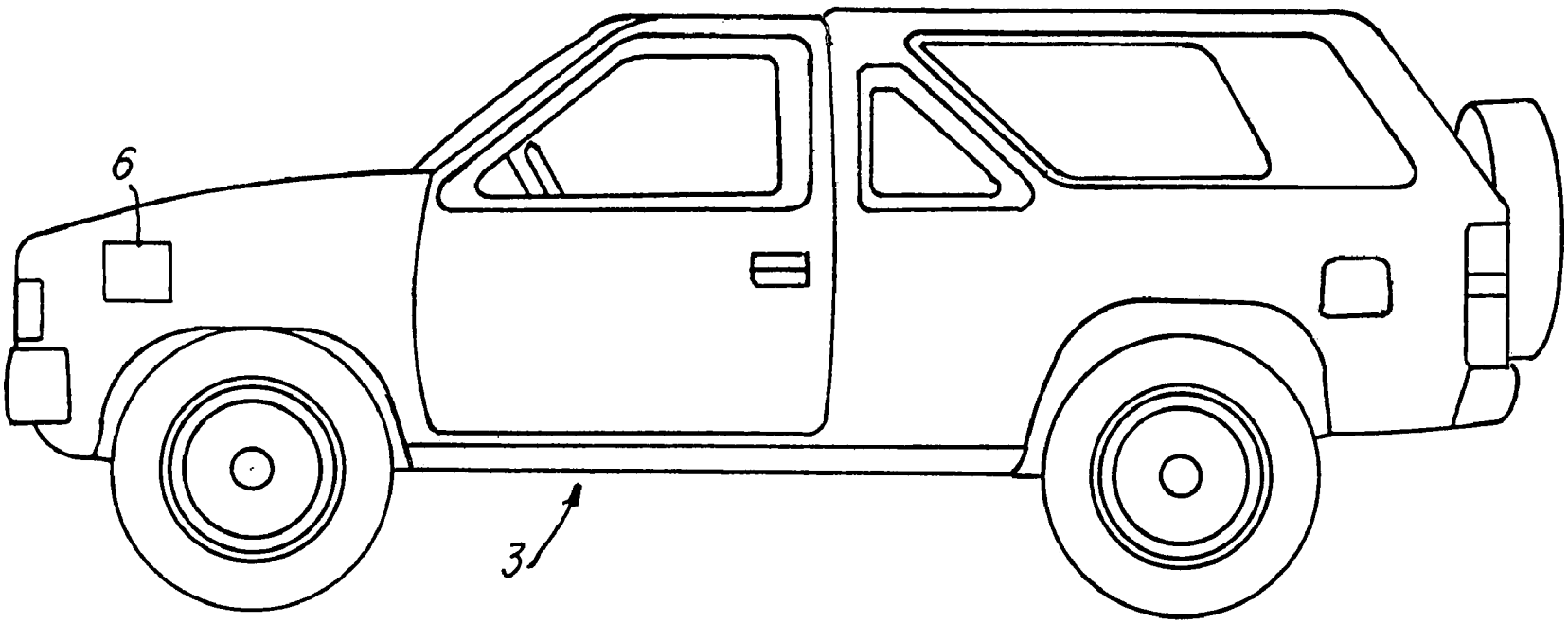
FIG-1 (PRIOR ART)
FIG. 1 illustrates a prior-art cooling fan 6 in a motor vehicle 3.

FIG. 1 indicates a cooling fan located in the engine compartment of vehicle 3. The Invention is applicable to fans generally, such as air conditioning fans and heating fans, and, if in a vehicle, whether located in the engine compartment or not.

A sixth group of features is indicated in FIG. 26, which provides test data derived from computer simulations of various fans. In the leftmost column, "uniform" refers to a uniform thickness in the ring, such as 2 mm, 3 mm, and so on, corresponding to dimension RD in FIG. 23. The entry "3 mm in gaps" refers to a thickness arrangement of the type shown in FIG. 19, wherein gaps are present in the added mass. The third row, labeled "base," refers to a baseline fan, against which the others are compared.

The central column, labeled "mass," refers to the amount of mass added.

In the rightmost two columns, quotients are given, indicating the relative effectiveness of masses in reducing deflection. The basic idea is to divide the amount of reduction in deflection by the mass responsible for the reduction, to attain a Fig.-of-merit for each addition of mass.

A seventh feature relates to positioning of the added mass. It was stated above that, in one embodiment, the additional mass does not occupy inwardly extending webs. However, in other embodiments, such webs, containing the added mass, can be used.

In one embodiment, the ring sections are uniform in thickness. In other embodiments, the ring sections can be non-uniform in thickness.

Mass need not be added to every ring section between adjacent blades. For example, a five-bladed fan may be used, and the spacing between blades need not be uniform. The non-uniform spacing is sometimes used to minimize acoustical noise.

If two adjacent blades are very close, then the ring section between them will be short. Such a short ring section may experience only a small deflection. Added mass may not be needed for such a ring section.

Thus, in some fans, some ring sections may contain added mass, and others may not.

Inward deflection of a ring section may not be centered about the mid-point between the blades between which the ring spans. In such a case, the added mass may be added at the point of maximal deflection which, again, may not be the mid-point.

The invention is applicable to raked blades. In one example of a raked blade, the leading edge progresses to the rear, that is, downstream, as one moves radially outward. In another example, the leading edge progresses to the front, that is, upstream, as one moves radially outward. In both examples, centrifugal force will tend to pull the blades into a pure radial position, and reduce the rake.

The ring sections can be of varied cross section, such as rectangular, oval, J-shaped, or L-shaped with one or more rounded corners.

An eighth feature is that inward deformation has been detected in the ring during operation of the fan. The invention applies added centrifugal force at selected points on the ring, to counteract the deformation. The added centrifugal force can be generated by addition of (1) a concentrated or distributed mass, (2) increased density at specific locations, (3) localized increases in thickness of the ring, or (4) other measures.

Numerous substitutions and modifications can be undertaken without departing from the true spirit and scope of the invention. What is desired to be secured by Letters Patent is the invention as defined in the following claims.

The invention claimed is:

1. An apparatus comprising:

a) an axial cooling fan having an array of fan blades, each of said array of fan blades having a pitch that is not adjustable and extending generally radially away from an axis of rotation to cause air to move generally parallel to said axis of rotation during rotation of said axial cooling fan, said array of fan blades surrounded by a ring connected to tips of the blades, said ring defining at least one sector between tips of adjacent ones of said array of fan blades; and b) means for reducing inward deflection of said ring at said at least one sector;

said means comprising a non-uniform mass integral with said at least one sector, a circumferential distribution of said mass being produced by varying the mass of the ring among a plurality of angular positions along the ring according to a computed or calculated simulation performed to determine the deflection of said ring, thereby producing a non-uniform distribution of mass in said ring to facilitate preventing inward deflection of said ring.

2. The apparatus according to claim 1, wherein the ring comprises a plurality of ring sectors, said means comprises additional mass integral with some of said plurality of sectors of the ring that is greater than a mass of said ring at others of said plurality of sectors.

3. The apparatus according to claim 2, wherein the additional mass occupies minimal radial depth.

4. The apparatus according to claim 2, wherein the additional mass does not occupy inwardly extending webs.

5. The apparatus according to claim 2, wherein the plurality of ring sectors containing additional mass are uniform in thickness.

6. The apparatus according to claim 2, wherein the plurality of ring sectors containing additional mass are uniform in thickness within 15 percent.

7. The apparatus according to claim 2, wherein the plurality of ring sectors containing additional mass are uniform in thickness within 20 percent.

8. The apparatus according to claim 2, wherein the plurality of ring sectors containing additional mass are uniform in thickness within 25 percent.

9. The apparatus according to claim 2, wherein the plurality of ring sectors containing additional mass are uniform in thickness within 30 percent.

10. The apparatus according to claim 2, wherein the plurality of ring sectors containing additional mass are uniform in thickness within 40 percent.

11. The apparatus according to claim 2, wherein the plurality of ring sectors containing additional mass are non-uniform in thickness.

12. The apparatus according to claim 1, wherein the axial cooling fan is contained in a motor vehicle.

13. An apparatus comprising:

a) an axial cooling fan having fan blades whose tips integrally support an outer ring, each of said fan blades having a pitch that is not adjustable and extending generally radially away from an axis of rotation to cause air to move generally parallel to said axis of rotation during rotation of said axial cooling fan;

said outer ring defining at least one sector between tips of adjacent ones of said array of fan blades and b) masses embedded in the outer ring in sectors between the blades and constructed of material of greater density than the outer ring, a circumferential distribution of said masses being produced by varying the masses on a plurality of angular positions along the outer ring according to a computed or calculated simulation performed to determine the deflection of said outer ring, thereby producing a non-uniform distribution of masses in said outer ring to facilitate preventing inward deflection of said outer ring.

14. The apparatus according to claim 13, wherein the axial cooling fan is contained in a motor vehicle.

15. An apparatus comprising:

a) an axial cooling fan having a rotor which comprises:

i) fan blades, and ii) an annular ring supported by the fan blades, each of said fan blades having a pitch that is not adjustable and extending generally radially away from an axis of rotation to cause air to move generally parallel to said axis of rotation during rotation of said axial cooling fan;

said annular ring defining at least one sector between tips of adjacent ones of said array of fan blades; and b) a plurality of masses distributed along the annular ring, a circumferential distribution of said plurality of masses being produced by varying said plurality of masses among a plurality of angular positions, respectively, along the ring, according to a computed or calculated simulation performed to determine the deflection of said ring such that greater mass is present between adjacent fan blades than radially outside the fan blades, thereby producing a non-uniform distribution of said plurality of masses in said ring to facilitate preventing inward deflection of said ring.

16. The apparatus according to claim 15, wherein the axial cooling fan is contained in a motor vehicle.

17. An axial cooling fan comprising:

a) at least two fan blades having tips, each of said fan blades having a pitch that is not adjustable and extending generally radially away from an axis of rotation to cause air to move generally parallel to said axis of rotation during rotation of said axial cooling fan; and b) a structure spanning between, and connecting to, the tips of said at least two fan blades, the structure being more massive near its mid-point at an area of said structure that tends to deflect inwardly upon rotation of said axial cooling fan than near the tips, a circumferential distribution of mass in said structure being produced by varying said mass of the structure at said mid-point according to a computed or calculated simulation performed to determine the deflection of said structure, thereby producing a non-uniform distribution of mass in said structure to facilitate preventing inward deflection.

18. The axial cooling fan according to claim 17, and further comprising:

c) N fan blades in addition to said at least two fan blades, and d) N+1 additional structures, i) each spanning between, and connecting to, a respective pair of blade tips, ii) each being more massive near its mid-point than near the pair of blade tips to which it connects, and iii) all structures forming a ring which surrounds the fan blades.

19. The axial cooling fan according to claim 18, wherein the axial cooling fan is contained in a motor vehicle.

20. The axial cooling fan according to claim 17, wherein the axial cooling fan is contained in a motor vehicle.

21. An axial cooling fan comprising:

a) an array of fan blades, each having a tip, wherein all tips together define a tip circle, each of said array of fan blades having a pitch that is not adjustable and extending generally radially away from an axis of rotation to cause air to move generally parallel to said axis of rotation during rotation of said axial cooling fan;

b) a ring which i) is connected to the tips at connection regions, ii) lies outside the tip circle, and iii) is more massive at mid-points between connection regions at areas of said ring that tend to deflect inwardly upon rotation of said axial cooling fan than at the connection regions;

a circumferential distribution of mass at said mid-points produced by varying the mass of the ring among a plurality of angular positions corresponding to said mid-points according to a computed or calculated simulation performed to determine the deflection of said ring at said mid-points, thereby producing a non-uniform distribution of mass in said ring in order to prevent inward deflection of said ring at said mid-points.

22. A method, comprising the steps of:

a) performing a computer simulation of an axial cooling fan, which axial cooling fan includes i) fan blades and ii) a ring which A) surrounds the blades, B) is connected to the tips of the blades, each of said fan blades having a pitch that is not adjustable and extending generally radially away from an axis of rotation to theoretically cause air to move generally parallel to said axis of rotation during rotation of said axial cooling fan; and C) is unsupported between the tips;

b) observing that, in operation, the ring bows inward at its unsupported regions;

c) adding simulated mass at the unsupported regions, and performing at least one additional simulation; and d) constructing an axial cooling fan to have non-uniform mass to reduce said inward bow in response to steps a)–c).

23. The method according to claim 22, and further comprising the step of:

a) constructing a plurality of axial cooling fans having greater mass in the rings than the simulated fan of paragraph (a).

24. The method according to claim 22, wherein the fan blades are raked.

25. The method according to claim 22, wherein the fan blades are raked and straight.

26. The method according to claim 22, wherein the ring is solid.

27. The method according to claim 22, wherein the ring is rectangular in cross section at locations between blades.

28. An axial cooling fan, comprising:

a) at least two fan blades having tips, each of said fan blades having a pitch that is not adjustable and extending generally radially away from an axis of rotation to cause air to move generally parallel to said axis of rotation during rotation of said axial cooling fans; and b) a structure spanning between, and connecting to, the tips of said two blades, the structure being more massive at one location, compared to other locations, a circumferential distribution of mass in said structure at said one location being produced by varying said mass of the structure at said one location according to a computed or calculated simulation performed to determine and prevent the deflection of said structure, thereby producing a non-uniform distribution of mass in said structure to facilitate preventing inward deflection of said structure at said one location.

29. The axial cooling fan according to claim 28, wherein, 1) if said one location is not more massive than other locations, the structure deforms inwardly during operation, and 2) the deformation at said one location is greater than deformation at other locations wherein said structure is more massive.

30. A cooling system for a vehicle, comprising:

an axial cooling fan comprising a plurality of fan blades, each of said fan blades having a pitch that is not adjustable and extending generally radially away from an axis of rotation to cause air to move generally parallel to said axis of rotation during rotation of said axial cooling fan; and a motor for driving an annular ring surrounding the blades;

said annular ring comprises plurality of masses or weights between at least two of said plurality of fan blades for improving performance of the axial cooling fan; and said annular ring comprises at least one sector between the said at least two of said plurality of fan blades, a circumferential distribution of said plurality of masses or weights being produced by varying the mass of the annular ring among a plurality of angular positions along the annular ring according to a computed or calculated simulation performed to determine the deflection of said annular ring, thereby producing a non-uniform distribution of mass in said annular ring to facilitate preventing inward deflection at areas of said annular ring.

31. The cooling system as recited in claim 30, wherein said plurality of fan blades are not equally spaced apart.

32. The cooling system as recited in claim 30, wherein said plurality of fan blades are swept.

33. The cooling system as recited in claim 30, wherein said plurality of fan blades are raked.

34. The cooling system as recited in claim 30, wherein said at least one mass or weight is not uniformly distributed across said at least one sector.

35. The cooling system as recited in claim 30, wherein said at least one sector comprises a density or thickness that is not uniform across its cross-section.

36. An apparatus, comprising:

a) an axial cooling fan having blades connected to a ring, wherein deformation occurs in the ring during operation, each of said fan blades having a pitch that is not adjustable and extending generally radially away from an axis of rotation to cause air to move generally parallel to said axis of rotation during rotation of said axial cooling fan;

said ring defining at least one sector between tips of adjacent ones of said fan blades; and b) means for reducing the deformation;

said means comprising a non-uniform mass integral with said at least one sector; a circumferential distribution of mass that is produced by varying the mass of the ring among a plurality of angular positions along the ring according to a computed or calculated simulation performed to determine the deflection of said ring, thereby producing said non-uniform mass in said ring to facilitate preventing inward deflection.

37. The apparatus as recited in claim 36, wherein said means comprises a mass located in a predetermined position on said ring.

* * * * *